US009784110B2

(12) United States Patent
Asai et al.

(10) Patent No.: US 9,784,110 B2
(45) Date of Patent: Oct. 10, 2017

(54) STEAM TURBINE ROTOR

(71) Applicant: Mitsubishi Hitachi Power Systems, Ltd., Yokohama, Kanagawa (JP)

(72) Inventors: Kunio Asai, Yokohama (JP); Masahiko Arai, Yokohama (JP); Kenichi Murata, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 452 days.

(21) Appl. No.: 14/453,782

(22) Filed: Aug. 7, 2014

(65) Prior Publication Data

US 2015/0044053 A1 Feb. 12, 2015

(30) Foreign Application Priority Data

Aug. 8, 2013 (JP) ..... 2013-164629

(51) Int. Cl.
*F01D 5/06* (2006.01)
*C22C 38/08* (2006.01)
*C22C 38/18* (2006.01)

(52) U.S. Cl.
CPC ..... *F01D 5/063* (2013.01); *C22C 38/08* (2013.01); *C22C 38/18* (2013.01);
(Continued)

(58) Field of Classification Search
CPC ..... F01D 5/063; C22C 38/18; F05D 2220/31; F05D 2230/235; F05D 2300/171; F05D 2300/175; F05D 2300/177
See application file for complete search history.

(56) References Cited

U.S. PATENT DOCUMENTS 6,085,417 A * 7/2000 Anderson, III ..... B23K 35/304 29/402.13
6,129,514 A * 10/2000 Shiga ..... C22C 38/44 415/199.5

(Continued)

FOREIGN PATENT DOCUMENTS

CA 2 834 753 A1 12/2012
CN 101765702 A 6/2010

(Continued)

OTHER PUBLICATIONS

Extended European Search Report dated Dec. 23, 2014 (eight (8) pages).

(Continued)

*Primary Examiner* — Kenneth Bomberg
*Assistant Examiner* — Hoon Choi
(74) *Attorney, Agent, or Firm* — Crowell & Moring LLP

(57) ABSTRACT

It is an objective of the invention to provide a steam turbine rotor that is capable of both reducing SCC susceptibility and improving LCF life thereof. There is provided a steam turbine rotor, comprising a rotor disk in a low pressure final stage L-0, and another rotor disk in a plurality of stages including a stage L-1 positioned closer to a high pressure side than the low pressure final stage L-0, the rotor disk in the low pressure final stage L-0 and the rotor disk in a plurality of stages including the stage L-1 being joined by welding, wherein a material of both the rotor disk in the low pressure final stage L-0 and the rotor disk in a plurality of stages including the stage L-1 is a 12Cr steel and has a tensile strength of 900 to 1200 MPa.

5 Claims, 2 Drawing Sheets

(52) U.S. Cl.
CPC .... *F05D 2220/31* (2013.01); *F05D 2230/235* (2013.01); *F05D 2300/171* (2013.01); *F05D 2300/175* (2013.01); *F05D 2300/177* (2013.01)

(56) References Cited

U.S. PATENT DOCUMENTS

| | | | | |
|---|---|---|---|---|
| 6,499,946 | B1 * | 12/2002 | Yamada | C22C 38/22 415/199.4 |
| 6,575,700 | B2 * | 6/2003 | Arai | C22C 38/001 415/200 |
| 8,414,267 | B2 * | 4/2013 | Ganesh | B21J 5/002 29/889.2 |
| 8,436,278 | B2 | 5/2013 | Keller et al. | |
| 2006/0118215 | A1 * | 6/2006 | Hirakawa | C21D 6/004 148/607 |
| 2006/0228217 | A1 | 10/2006 | Roberts et al. | |
| 2014/0133986 | A1 * | 5/2014 | Matsuoka | B23K 15/0073 416/124 |

FOREIGN PATENT DOCUMENTS

| | | | | |
|---|---|---|---|---|
| EP | 1 669 473 | A1 | | 6/2006 |
| EP | 2 180 147 | A1 | | 4/2010 |
| JP | 2001-50002 | A | | 2/2001 |
| JP | 2001050007 | A | * | 2/2001 |
| JP | 3716684 | B2 | | 11/2005 |
| JP | 2006-307840 | A | | 11/2006 |

OTHER PUBLICATIONS

Chinese Office Action issued in counterpart Chinese Application No. 201410387940.0 dated Jun. 2, 2015, with partial English translation (fifteen (15) pages).

Guo Kang Min, "12Cr Steel for Power Industry", Steam Turbine Technology, vol. 1985 1st. period, Mar. 2, 1985, pp. 39-58.

* cited by examiner

STEAM TURBINE ROTOR

CLAIM OF PRIORITY

The present application claims priority from Japanese patent application serial no. 2013-164629 filed on Aug. 8, 2013, the content of which is hereby incorporated by reference into this application.

BACKGROUND OF THE INVENTION

1. Field of the Invention

The present invention relates to steam turbine rotors, and particularly to a steam turbine rotor suitable for a steam turbine used in a large scale power generation plant or a gas turbine-combined power generation plant.

2. Description of Related Art

A turbine rotor of a common steam turbine is in a severe corrosive environment because normally, its low pressure stages (e.g., the low pressure final stage L-0 to the stage L-4 on a higher pressure side) are positioned under a wet steam condition or a dry and wet alternate condition, where dry steam and wet steam by turns exists.

In general, a low alloy steel such as a 3.5% Ni steel and a 1% CrMoV steel is adopted as a rotor material in low pressure stages of a steam turbine taking its mechanical strength, toughness, and large piece forgeability into account. Unfortunately, however, since its corrosion resistance is not necessarily high, long-time use of a low alloy steel in a plant can cause a corrosive medium to accumulate in the gaps between blades and blade implant parts of a rotor and result in stress corrosion cracking (hereinafter referred to as SCC).

Also, since blades with a long blade length (long blades) are employed in the low pressure final stage L-0, high centrifugal stress occurs at the blade implant parts. In the steam turbine of a combined power generation plant, in particular, variations in, and repeated application of, centrifugal stress accompanying starting/stopping operations can reduce low cycle fatigue life (hereinafter referred to as LCF life) of the steam turbine rotor in a corrosive environment.

Techniques to enhance the reliability of a turbine rotor used in the low pressure final stage L-0 of a steam turbine include those described in Patent Literatures 1 and 2, for example.

Patent Literature 1 (JP 2001-50002 A) discloses that a 12Cr steel with high corrosion resistance is employed as a rotor material used in the low pressure final stage L-0. Also, Patent Literature 2 (JP 2006-307840 A) discloses that susceptibility to SCC is reduced by reducing the yield strength of a rotor material in the low pressure final stage L-0 to the stage L-2 in such a way that the yield strength is lower toward the high pressure side.

As described above, major conventional problems related to low pressure turbine rotors of steam turbines are how to improve LCF life in the low pressure final stage L-0 in a corrosive environment and how to reduce SCC susceptibility in the low pressure final stage L-0 to the stage L-4.

Meanwhile, in recent years, blades in the low pressure final stage L-0 have been getting longer; blades with a length equal to or longer than 1250 mm can be employed at 3600 rpm, for example. Also, with this trend toward longer blades in the low pressure final stage L-0, blades in stages L-1 and L-2 which are closer to the high pressure side than the low pressure final stage L-0 are also becoming longer. This poses a requirement of improving LCF life in a corrosive environment even in such stages as L-1 and L-2, where it has not been much of a problem.

Moreover, in the stages L-1 and L-2, which are closer to the high pressure side than the low pressure final stage L-0, reducing SCC susceptibility is even more necessary. This is because the temperature and SCC susceptibility in the stages L-1 and L-2 are higher than those in the low pressure final stage L-0.

However, neither the JP 2001-50002 A nor JP 2006-307840 A mentioned above sufficiently discloses any materials or mechanical strength appropriate to reduce SCC susceptibility and, at the same time, to improve LCF life in stages L-1 and L-2, which are closer to the high pressure side than the low pressure final stage L-0.

SUMMARY OF THE INVENTION

The present invention has been made in view of the above. And it is an objective of the present invention to provide a steam turbine rotor that is capable of both reducing SCC susceptibility and improving LCF life of blades and rotor disks in stages including the low pressure final stage L-0 and the stage L-1 positioned closer to the high pressure side than the low pressure final stage L-0.

According to an aspect of the present invention, there is provided a steam turbine rotor, comprising a rotor disk in a low pressure final stage L-0, and another rotor disk in a plurality of stages including a stage L-1 positioned closer to a high pressure side than the low pressure final stage L-0, the rotor disk in the low pressure final stage L-0 and the rotor disk in a plurality of stages including the stage L-1 being joined by welding, wherein a material of both the rotor disk in the low pressure final stage L-0 and the rotor disk in a plurality of stages including the stage L-1 is a 12Cr steel and has a tensile strength of 900 to 1200 MPa.

In the above aspect of the invention, the following modifications and changes can be made.

(i) The 12Cr steel that forms both the rotor disk in the low pressure final stage L-0 and the rotor disk in a plurality of stages including the stage L-1 contains 8.0 to 13 mass % of Cr.

(ii) The rotor disk material in the low pressure final stage L-0 and the rotor disk material in a plurality of stages including the stage L-1 are the same material.

(iii) The rotor disk in a plurality of stages including the stage L-1 includes a stage L-2 in addition to the stage L-1;

the steam turbine rotor further comprises another rotor disk in a plurality of stages that is positioned closer to a high pressure side than the rotor disk in a plurality of stages including the stages L-1 and L-2, the rotor disk in a plurality of stages that is positioned closer to a high pressure side than the stage L-2 being joined by welding to the rotor disk in a plurality of stages including the stages L-1 and L-2; and a material of the rotor disk in a plurality of stages that is positioned closer to a high pressure side than the stage L-2 is a 3.5% NiCrMoV steel or a 1% CrMoV steel.

(iv) The material of the rotor disk in a plurality of stages that is positioned closer to a high pressure side than the stage L-2 has a tensile strength of 600 to 750 MPa.

(v) The 12Cr steel that forms both the rotor disk in the low pressure final stage L-0 and the rotor disk in a plurality of stages including the stage L-1 further contains 0.10 to 0.35 mass % of C, 1.5 to 4.0 mass % of Mo, 0.8 to 3.2 mass % of Ni, 0.15 to 0.3 mass % of V, 0.1 to 0.3 mass % of Nb, and 0.04 to 0.10 mass % of N.

(vi) The rotor disk in the low pressure final stage L-0 and the rotor disk in a plurality of stages including the stage L-1 are joined by any one of TIG welding, submerged arc welding, and coated arc welding.

(vii) The steam turbine rotor is a 3600-rpm steam turbine rotor; a length of blades in the low pressure final stage L-0 is equal to or greater than 1250 mm; and a length of blades in the stage L-1 is equal to or greater than 700 mm.

Advantages of the Invention

According to the present invention, it is possible to provide a steam turbine rotor that is capable of both reducing SSC susceptibility and improving LCF life of blades and rotor disks in stages including the low pressure final stage L-0 and the stage L-1 positioned closer to the high pressure side than the low pressure final stage L-0.

DETAILED DESCRIPTION OF THE PREFERRED EMBODIMENTS

Figure 1:
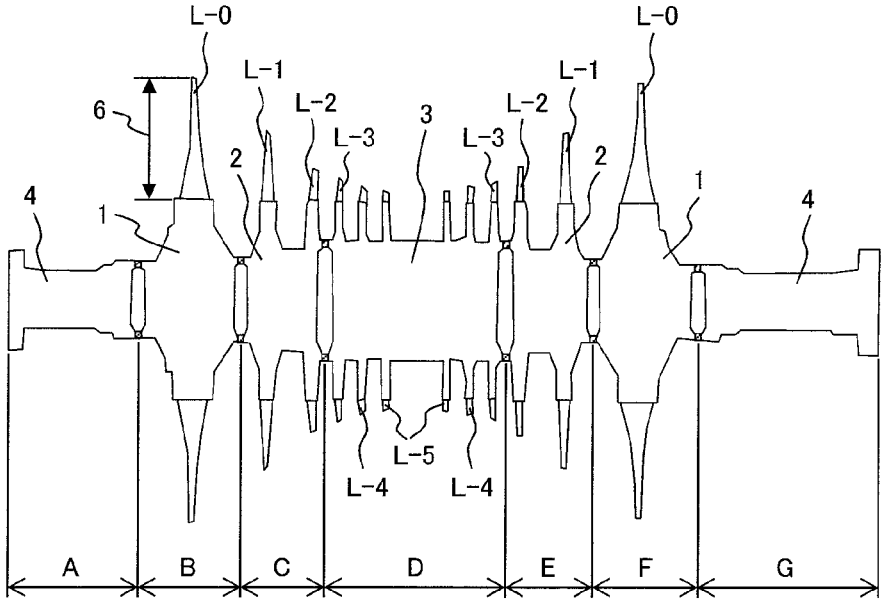
FIG. 1 is a schematic diagram showing an exemplary steam turbine rotor in accordance with a first embodiment of the present invention.

Preferred embodiments of a steam turbine rotor according to the present invention will be described hereinafter with reference to the accompanying drawings. In the drawings, like parts are designated by like reference numerals without repeating the description thereof. The invention is not limited to the specific embodiments described below, and various combinations and modifications are possible without departing from the technical idea of the invention, where appropriate.

First Embodiment

FIG. 1 is a schematic diagram showing an exemplary steam turbine rotor in accordance with a first embodiment of the present invention. The steam turbine rotor shown in FIG. 1 is a double-flow low pressure steam turbine rotor.

As shown in FIG. 1, the steam turbine rotor in the present embodiment comprises: rotor disks 1 (segments B and F in FIG. 1) in the low pressure final stages L-0; rotor disks 2 (segments C and E in FIG. 1) that form stages L-1 and L-2 positioned one stage closer to the high pressure side than the low pressure final stages L-0; a rotor disk 3 (segment D in FIG. 1) that forms stages L-3, L-4, and L-5 positioned closer to the high pressure side than the stage L-2; and rotor disks 4 (segments A and G in FIG. 1) in a bearing portion. Each of these rotor disks 1 to 4 is joined by any one of TIG welding, submerged arc welding, and coated arc welding.

The steam turbine rotor in the present embodiment is preferable to be used in a 3600-rpm steam turbine. A length 6 of blades in the low pressure final stage L-0 in the present embodiment is equal to or greater than 1250 mm (preferably, e.g. 1270 mm), a length of blades in the stage L-1 is equal to or greater than 700 mm (preferably, e.g. 780 mm), and a length of blades in the stage L-2 is equal to or greater than 300 mm (preferably, e.g. 360 mm).

Also, in the present embodiment, a 12Cr steel having a tensile strength of 900 MPa or greater and 1200 MPa or less is employed as a material for the rotor disks 1 (segments B and F in FIG. 1) in the low pressure final stages L-0 and the rotor disks 2 (segments C and E in FIG. 1) that form the stages L-1 and L-2, positioned closer to the high pressure side than the low pressure final stages L-0.

In the present embodiment, there is no need to intentionally make the tensile strength in segments B and F in FIG. 1 (the rotor disks 1 in the low pressure final stages L-0) and the tensile strength in segments C and E in FIG. 1 (the rotor disks 2 forming the stages L-1 and L-2) different from each other. As long as the tensile strength is within a range from 900 to 1200 MPa inclusive, the advantageous effects of prolonging corrosion LCF life and reducing SCC susceptibility are obtained. In other words, the rotor disks 1 and the rotor disks 2 may be formed of the same material.

Meanwhile, in the present embodiment, a 3.5% NiCrMoV steel of a low alloy steel is employed for the rotor disk 3 forming the stages L-3, L-4, and L-5 (segment D in FIG. 1), which is positioned closer to the higher pressure side than the rotor disks 2 forming the stages L-1 and L-2 (segments C and E in FIG. 1), and its tensile strength is preferably 600 to 750 MPa.

Furthermore, a 1% CrMoV steel of a low alloy steel is employed for the rotor disks 4 in the bearing portion (segments A and G). A low alloy steel is used for the rotor disks 4 in the bearing portion because it reduces seizure on the bearing and galling damage.

By forming the steam turbine rotor components in the present embodiment as described above, the steam turbine rotor can achieve SCC susceptibility reduction, which is required for all the stages from the low pressure final stage L-0 to the stage L-5, even in a harsh centrifugal force condition with the blade length in the low pressure final stage being over 1250 mm. And at the same time, the steam turbine rotor can improve LCF life in the stages from the low pressure final stage L-0 to the stage L-2 in a corrosive environment.

Next, experiments conducted by the inventors to verify the advantageous effects of the present invention will be described, and the advantageous effects of the present invention will be more specifically described.

First, in a corrosive environment simulated to be an actual machine environment (pure water, dissolved oxygen level: 150 ppb, pH: 8, temperature: 50° C.), a low cycle fatigue test was conducted using notched test pieces. The test was conducted in a form of vibration of a cantilever (load frequency: 0.01 Hz) under conditions of simulated centrifugal force load/removal due to starting/stopping operations. A 3.5% NiCrMoV steel and three kinds of 12Cr steel that were different in tensile strength were used as the test piece materials.

Figure 2:
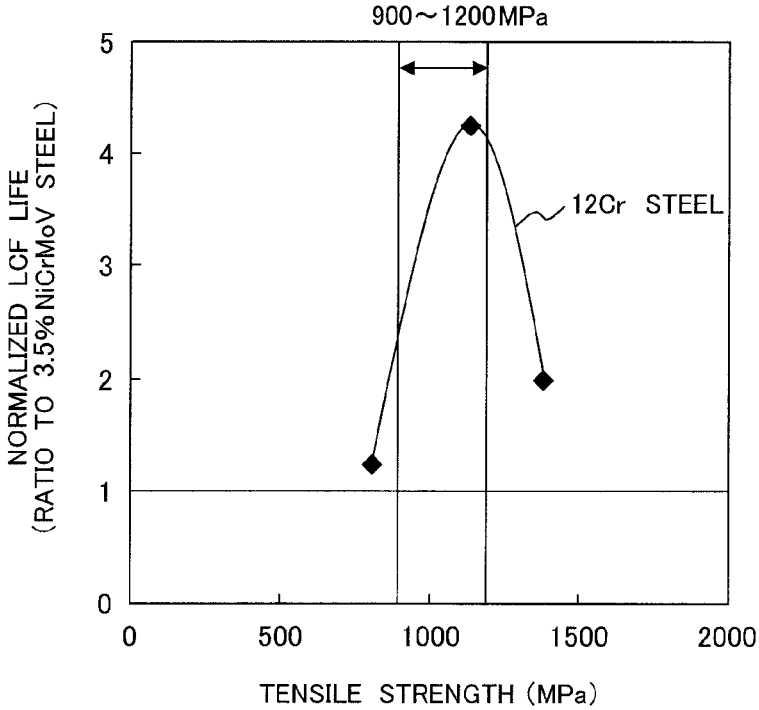
FIG. 2 is a graph showing a relationship between tensile strength and normalized LCF life in 12Cr steel.

The test results are shown in FIG. 2. FIG. 2 is a graph showing a relationship between tensile strength and normalized LCF life in the 12Cr steel. The normalized LCF life is LCF life normalized based on the LCF life of the 3.5% NiCrMoV steel in the same strain range condition.

As shown in FIG. 2, the 12Cr steel exhibited the greatest effect of improving LCF life as compared with the 3.5% NiCrMoV steel when its tensile strength was about 1100 MPa. Also, the 12Cr steel with a tensile strength of about 800 MPa had almost the same LCF life with that of the 3.5% NiCrMoV steel. This is considered to be because low tensile strength led to increased plastic strain at the notch bottom, which made life reduction dominant and cancelled the corrosion resistance improvement effect of the 12Cr steel.

Meanwhile, the 12Cr steel with a tensile strength of about 1400 MPa was less effective in improving LCF life as compared with the 12Cr steel with a tensile strength of 1100 MPa. Presumably, this is due to the fact that the effect of mean stress (in a cantilever vibration test using notched test pieces, the value of mean stress is positive) becomes larger as hardness becomes higher, notch sensitivity is high, etc.

Figure 3:
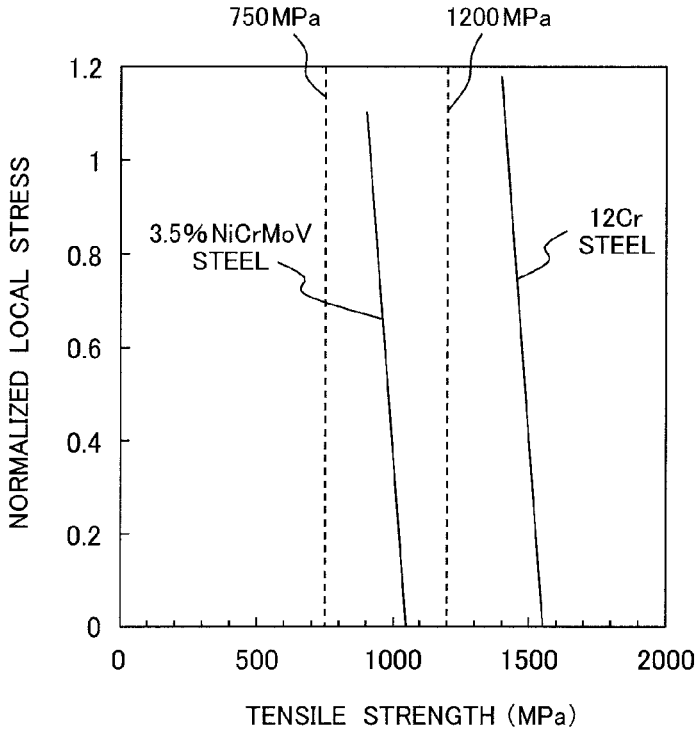
FIG. 3 is a graph showing a relationship between tensile strength of steel and normalized local stress.

FIG. 3 is a graph showing a relationship between tensile strength of steel and normalized local stress, and the normalized local stress is localized stress converted into elastic stress and normalized based on the local stress on a turbine rotor material that occurs in the low pressure final stage L-0. FIG. 3 shows a relationship between tensile strength and critical stress for SCC in the 12Cr steel and the 3.5% NiCrMoV steel.

As shown in FIG. 3, critical strength for SCC decreases as tensile strength increases with both the 12Cr steel and the 3.5% NiCrMoV steel. The SCC critical line for the 12Cr steel is positioned closer to higher stress side on the horizontal axis than that of the 3.5% NiCrMoV steel, indicating that its SCC susceptibility is higher.

Also, as shown in FIG. 3, in the 3.5% NiCrMoV steel, a sufficient margin can be secured with respect to the SCC critical line by making adjustments in such a way that the tensile strength is about 750 MPa or lower. Similarly, as for the 12Cr steel, a sufficient margin can be secured with respect to the SCC critical line by making adjustments in such a way that the tensile strength is 1200 MPa or lower.

From the test results above, it has been confirmed that by employing a 12Cr steel with a tensile strength of 900 to 1200 MPa as a material for the low pressure final stage L-0 and the stages L-1 and L-2 of a turbine rotor, LCF life in a corrosive environment can be improved, as shown in FIG. 2, and a sufficient margin can be secured with respect to SCC critical stress, as shown in FIG. 3.

In other words, in order to improve the LCF life of a steam turbine rotor in a corrosive environment more than by using a 3.5% NiCrMoV steel, merely employing a 12Cr steel is not sufficient; it requires use of a 12Cr steel with a tensile strength of 900 to 1200 MPa, and it can be achieved most effectively by using a 12Cr steel with a tensile strength of about 1100 MPa.

Also, in the stages L-3, L-4, and L-5, where corrosion LCF life due to centrifugal stress is not much of a problem as the blades are short, it is desirable in terms of reliability and economy that a 3.5% NiCrMoV steel with a tensile strength of 600 to 750 MPa be used to reduce SCC susceptibility, which is a major damage factor.

Moreover, since 12Cr steels are more expensive than 3.5% NiCrMoV steels, adopting such a material combination to limit the amount of expensive 12Cr steel to the minimum required can minimize the impact on costs while improving the properties of the steam turbine rotor.

In the present embodiment, a rotor disk comprising stages L-1 and L-2 in segments C and E has been described; however, the present invention is not to be construed as limited thereto. It is obvious that the same advantageous effects as described above can be obtained with a rotor disk that consists of a stage L-1 only or a rotor disk having a single-piece construction comprising multiple stages including stages L-1 to L-3 or L-4, for example, in segments C and E.

Next, an appropriate chemical composition of the 12Cr steel to be employed for the low pressure final stage L-0 to the stage L-2 in the present embodiment will be described.

The appropriate chemical composition of the 12Cr steel to be employed for the low pressure final stage L-0 to the stage L-2 in the present embodiment contains, by mass, 0.10% or greater and 0.35% or less of C (carbon), 1.5% or greater and 4.0% or less of Mo (molybdenum), 0.8% or greater and 3.2% or less of Ni (nickel), 0.15% or greater and 0.3% or less of V (vanadium), 0.1% or greater and 0.3% or less of Nb (niobium), 0.04% or greater and 0.10% or less of N (nitride), and 8.0% or greater and 13% or less of Cr (chromium), with the balance being Fe (iron) and inevitable impurities.

In order to obtain high tensile strength, the content of the C needs to be at least 0.10 mass %. The content of the C should be set to 0.35 mass % or less because an excessive C content can reduce toughness and weldability.

The Mo component increases mechanical strength through its solid solution strengthening and carbide/nitride precipitation strengthening effects. The content of the Mo is preferably 1.5 to 4.0 mass % because an Mo content of less than 1.5 mass % would not bring about a sufficient mechanical strength improvement effect and an Mo content of more than 4.0 mass % would cause a δ ferrite phase to form.

In addition, because W (tungsten) and Co (cobalt) have effects similar to those of Mo, these can be included in the chemical composition in order to further increase the mechanical strength as long as the total content (the total of Mo, W, and Co) is 4.0 mass % or less.

The Ni component has the effect of increasing low temperature toughness and preventing δ ferrite phase formation. This effect would be insufficient with an Ni content of less than 0.8 mass % and become saturated with an Ni content of more than 3.2 mass %. Therefore, the content of the Ni is preferably 0.8 to 3.2% and more preferably 1.0 to 3.0%.

The V component and the Nb component have the effect of precipitating carbides and increasing tensile strength while at the same time improving toughness. This effect would be insufficient with a V content of less than 0.15 mass % and an Nb content of less than 0.1 mass %. On the other hand, from the viewpoint of inhibiting δ ferrite phase formation, the content of the V is preferably 0.3 mass % or less, and the content of the Nb is preferably 0.3 mass % or less. Therefore, the content of the V is preferably 0.15 to 0.3 mass % and more preferably 0.20 to 0.3 mass %, and the content of the Nb is preferably 0.1 to 0.3 mass % and more preferably 0.12 to 0.22 mass %.

In addition, instead of the Nb component, Ta (tantalum) can be added in an identical manner. In the case where Nb and Ta are added together, the total content (the total of Nb and Ta) is the same as the case where Nb is independently added.

The N component has the effect of improving mechanical strength and preventing δ ferrite phase formation. This effect would be insufficient with an N content of less than 0.04 mass %, and toughness and weldability would decrease with an N content of more than 0.10 mass %. Therefore, the content of the N is preferably 0.04 to 0.10 mass %.

The Cr component has the effect of increasing corrosion resistance and tensile strength. A Cr content of more than 13 mass % would cause a δ ferrite phase to form, while a Cr content of less than 8 mass % would result in insufficient corrosion resistance. Therefore, the content of the Cr is preferably 8.0 to 13 mass %. Also, from the viewpoint of mechanical strength, the content of the Cr is preferably 10.5 to 12.8 mass %.

In addition to the above, the 12Cr steel used in the present invention may contain Si (silicon) and Mn (manganese). Si and Mn are often added in dissolving steel as a deoxidizing agent and a desulfurizing/deoxidizing agent, respectively. These are effective even in small quantities.

However, because an excessive addition of Si would cause formation of a harmful δ ferrite phase, which causes fatigue and reduces toughness, the content of the Si needs to be 0.5 mass % or less and preferably 0.1 mass % or less. Incidentally, in the case of dissolving steel by carbon vacuum deoxidation or electroslag remelting, there is no need to add Si, or rather it is better not to add it.

The Mn component is effective as a desulfurizing agent and also has the effect of improving toughness. However, if it is added in an excessive amount, it reduces toughness. Therefore, the content of the Mn is preferably 0.33 mass % or less. Also, from the viewpoint of improving toughness, the content of the Mn is more preferably 0.30 mass % or less, even more preferably 0.25 mass % or less, and most preferably 0.20 mass % or less.

Moreover, it is important to take account of the following. Reducing P (phosphorous) content and S (sulfur) content has the effect of improving low temperature toughness, and therefore it is desirable to reduce it as much as possible. From the viewpoint of improving low temperature toughness, the content of the P is preferably 0.015 mass % or less, and the content of the S is preferably 0.015 mass % or less.

Similarly, reducing Sb (antimony) content, Sn (tin) content, and As (arsenic) content has the effect of improving low temperature toughness, and therefore it is desirable to reduce it as much as possible. In view of the current level of steelmaking technology, the content of the Sb is preferably 0.0015 mass % or less, the content of the Sn is preferably 0.01 mass % or less, and the content of the As is preferably 0.02 mass % or less.

In the present embodiment, the turbine rotor components are joined preferably by any one of TIG welding, submerged arc welding, and coated arc welding. Also, it is preferable that the welding is followed by heat treatment at 560 to 580° C. to fully eliminate the residual stress in the entire turbine rotor and inhibit the formation of a reverse-transformation austenitic phase so that the rotor disks are entirely in tempered martensitic phase, and the low alloy rotor is in tempered bainite phase.

Second Embodiment

Figure 4:
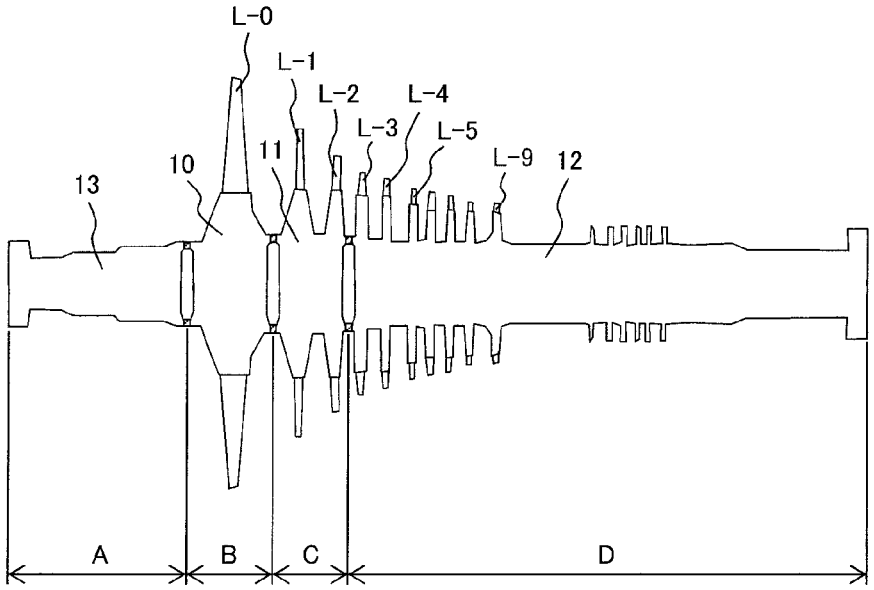
FIG. 4 is a schematic diagram showing an exemplary steam turbine rotor in accordance with a second embodiment of the present invention.

FIG. 4 is a schematic diagram showing an exemplary steam turbine rotor in accordance with a second embodiment of the present invention. The steam turbine rotor shown in FIG. 4 is a steam turbine rotor having a high and low pressure-integrated construction in which high pressure stages and low pressure stages are integrated. Steam turbine rotors having this type of high and low pressure-integrated construction are often used in combined power generation plants.

A 12Cr steel having a tensile strength of 900 to 1200 MPa is employed as a material for a rotor disk 10 (segment B in FIG. 4) in the low pressure final stage L-0 and a rotor disk 11 (segment C in FIG. 4) in the stages L-1 and L-2 positioned closer to the high pressure side than the low pressure final stage L-0 of the steam turbine rotor in the present embodiment, in the same manner as in the first embodiment. Also, a 1% NiCrMoV steel, a low alloy steel, is employed for a rotor disk 12 (segment D in FIG. 4) in the stage L-3 and the stages positioned closer to the high pressure side than the stage L-3, and its tensile strength has been adjusted to 600 to 750 MPa.

In the present embodiment, segment D is composed of a high and low pressure-integrated rotor; however, forming the high pressure stage portion of a heat resistant 12Cr steel would bring about the effect of improving high temperature creep strength. Also, a 1% CrMoV steel, a low alloy steel, is preferably used for a turbine disk 13 (segment A in FIG. 4) in the bearing portion to reduce seizure on the bearing and galling damage.

As is the case with the first embodiment, by forming a steam turbine rotor in the present embodiment as described above, the steam turbine rotor can achieve SCC susceptibility reduction, which is required for all the stages from the low pressure final stage L-0 to the stage L-9, and at the same time can improve LCF life in the stages from the low pressure final stage L-0 to the stage L-2 in a corrosive environment.

In the present embodiment, a rotor disk comprising stages L-1 and L-2 in segment C has been described; however, the present invention is not to be construed as limited thereto. It is obvious that the same advantageous effects as described above can be obtained with a rotor disk that consists of a stage L-1 only or a rotor disk comprising multiple stages including stages L-1 to L-3 or L-4, for example, in segment C.

Although the invention has been described with respect to the specific embodiments for complete and clear disclosure, the appended claims are not to be thus limited but are to be construed as embodying all modifications and alternative constructions that may occur to one skilled in the art which fairly fall within the basic teaching herein set forth.

What is claimed is:

1. A steam turbine rotor, comprising:

a plurality of rotor disks, each of which mounts one or more stages of blades; and another rotor disk in a bearing portion positioned at an end of the steam turbine rotor, all of the rotor disks being joined by welding;

wherein said plurality of rotor disks includes:

a rotor disk mounting blades of a low pressure final stage L-0;

another rotor disk, positioned adjacent to and on a higher pressure side of the rotor disk of the low pressure final stage L-0, mounting blades of at least a stage L-1; and still another rotor disk, positioned adjacent to and on a higher pressure side of the rotor disk mounting blades of at least the stage L-1, mounting blades of higher stages than that of the other rotor disk mounting the blades of at least the stage L-1; and wherein:

a material of both the rotor disk mounting the blades of the low pressure final stage L-0 and the rotor disk mounting the blades of at least the stage L-1 is a 12Cr steel and has a tensile strength of 900 to 1200 MPa;

a material of the still another rotor disk mounting blades of higher stages than that of the other rotor disk mounting the blades of at least stage L-1 is a 3.5% NiCrMoV steel and has a tensile strength of 600 to 750 MPa; and a material of the rotor disk in the bearing portion is a 1% CrMoV steel.

2. The steam turbine rotor according to claim 1, wherein the 12Cr steel contains 0.10 to 0.35 mass % of C, 1.5 to 4.0 mass % of Mo or a total of Mo, W, and Co of 1.5 to 4.0 mass %, 0.8 to 3.2 mass % of Ni, 0.15 to 0.3 mass % of V, 0.1 to 0.3 mass % of Nb or a total of Nb and Ta of 0.1 to 0.3 mass %, 0.04 to 0.10 mass % of N, and Cr of 8.0 to 13 mass %, with the balance being Fe and inevitable impurities.

3. The steam turbine rotor according to claim 2, wherein the material of the rotor disk mounting blades of the low pressure final stage L-0 and the material of the other rotor disk mounting blades of at least the stage L-1 are the same material.

4. The steam turbine rotor according to claim 1, wherein all of the rotor disks are joined by any one of TIG welding, submerged arc welding, and coated arc welding.

5. The steam turbine rotor according to claim 1, wherein:

the steam turbine rotor is a 3600-rpm steam turbine rotor;

a length of blades in the low pressure final stage L-0 is equal to or greater than 1250 mm; and a length of blades in the stage L-1 is equal to or greater than 700 mm.

* * * * *